US005167132A

United States Patent [19]

Meier

[11] Patent Number: 5,167,132

[45] Date of Patent: Dec. 1, 1992

[54] AUTOMATIC ICE BLOCK MACHINE

[76] Inventor: Gary B. Meier, 665 24½ Rd., Grand Junction, Colo. 81505

[21] Appl. No.: 729,928

[22] Filed: Jul. 15, 1991

[51] Int. Cl.[5] ..... F25C 1/06

[52] U.S. Cl. ..... 62/352; 62/356

[58] Field of Search ..... 62/356, 352, 73

[56] References Cited

U.S. PATENT DOCUMENTS

| | | | |
|---|---|---|---|
| 2,613,506 | 10/1952 | Cook | 62/352 X |
| 2,723,534 | 11/1955 | Wilbushewich | 62/352 X |
| 2,768,507 | 10/1956 | Hoen | 62/356 X |
| 3,040,541 | 6/1962 | Jones et al. | 62/352 X |
| 3,277,661 | 10/1966 | Dwyer | 62/352 X |
| 4,199,956 | 4/1980 | Lunde | 62/352 X |

*Primary Examiner*—William E. Tapolcai

*Attorney, Agent, or Firm*—Donald W. Erickson

[57] ABSTRACT

A machine for making and harvesting blocks of ice which is totally automatic. The machine has an ice block forming ice chamber with a counter balanced hinged lid as the bottom wall of the chamber. A small amount of water is introduced into the lid which is frozen to form an ice seal between the bottom lid and the bottom flanged edge of the side walls of the chamber. The balance of the water according to the size of block ice is then introduced and frozen. The block is harvested by defrosting using a hot gas cycle to break the ice seal and defrost the side walls of the ice chamber. The ice block falls by gravity from the chamber onto a slide system. The hinged lid returns to the closed position and the machine restarts automatically to produce the next block of ice.

4 Claims, 4 Drawing Sheets

TIMER SETTINGS:

T-1
MODE 1 ON TIME

T-2A
MODE 2 FIRST ON TIME

T-2B
MODE 2 OFF TIME

T-2C
MODE 2 SECOND ON TIME

T-3
MODE 3 ON TIME

AUTOMATIC ICE BLOCK MACHINE

BACKGROUND OF THE INVENTION

This invention relates to an ice machine which makes and harvests blocks of ice automatically. Existing machines for making blocks of ice are unduly complex, not energy cost effective and/or require the presence of personnel to operate the machine. These factors lead to increased costs of production of ice blocks. The ice machine of the present invention overcomes the aforementioned disadvantages.

SUMMARY OF THE INVENTION

The present invention is directed at an ice machine which is energy cost effective and does not require the attendance of an operator while making and harvesting blocks of ice. The machine is totally automatic and can operate twenty-four hours a day without the presence of an operator. The machine of the present invention includes an ice block forming ice chamber having a counter balanced hinged lid as the bottom of the chamber. In operation, the machine automatically introduces a small amount of water into the ice chamber sufficient to fill or substantially fill the bottom lid. This small amount of water is frozen which causes the formation of an ice seal between the bottom lid and the lower edges of the ice chamber walls. The seal thus formed is strong and leakproof. Thereafter, the machine automatically introduces the balance of the water in accordance with the size of the block of ice desired. When the freezing cycle is completed, the ice chamber walls and bottom lid are warmed sufficiently to break said ice seal and to release the ice block from the chamber. The weight of the ice block is adequate to cause the counter balanced lid to open and permit the block to gravity drop onto an inclined platform or the like. The hinged counter balanced lid returns to its closed position to form the bottom wall of the ice chamber and the operation automatically restarts to continue ice block production. The machine can have a single ice chamber or a plurality such as 5, 10 or more ice chambers.

DETAILED DESCRIPTION OF THE INVENTION

Figure 1:
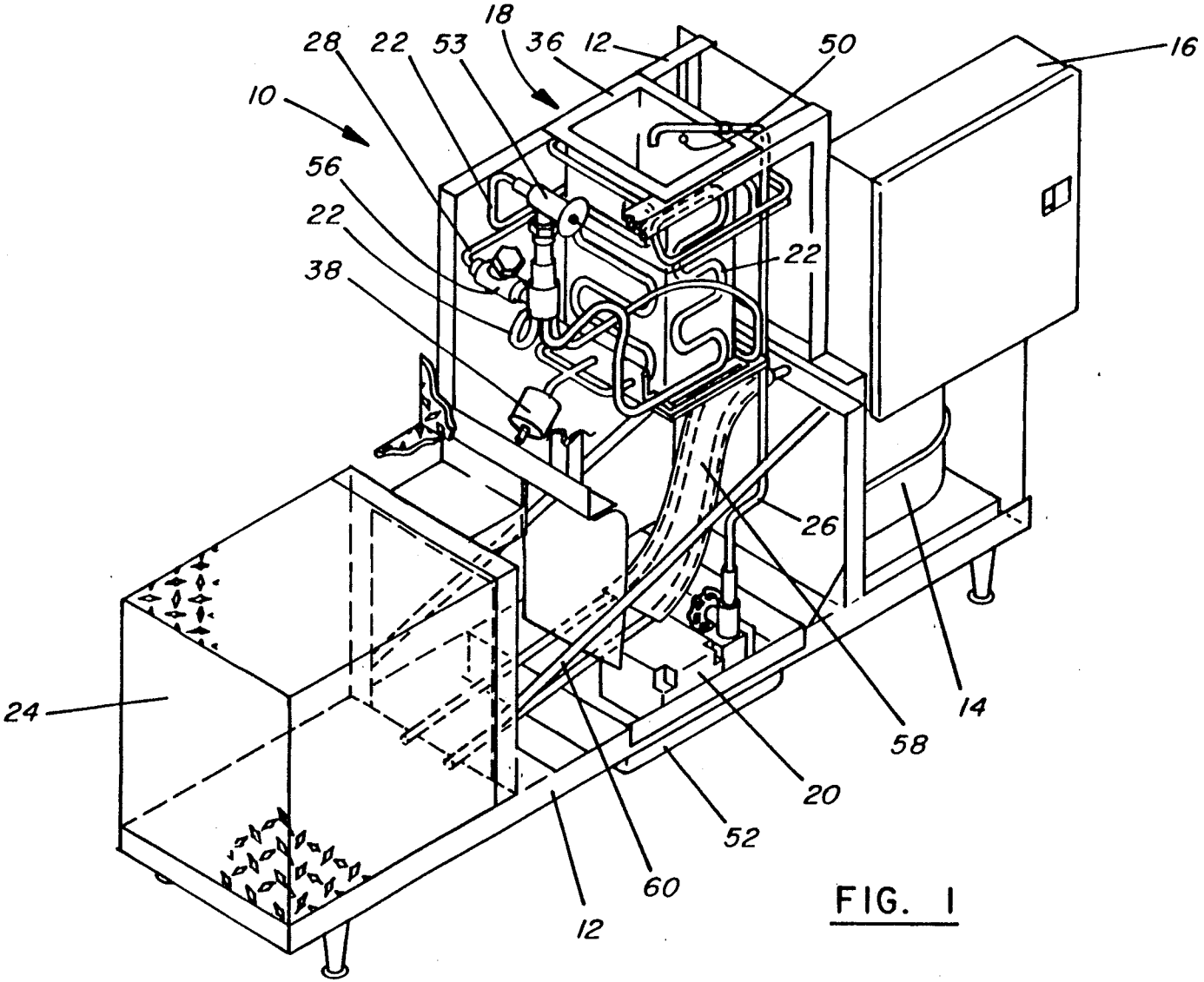
FIG. 1 is an upper, left frontal perspective view of an ice block machine in accordance with the present invention.
Figure 2:
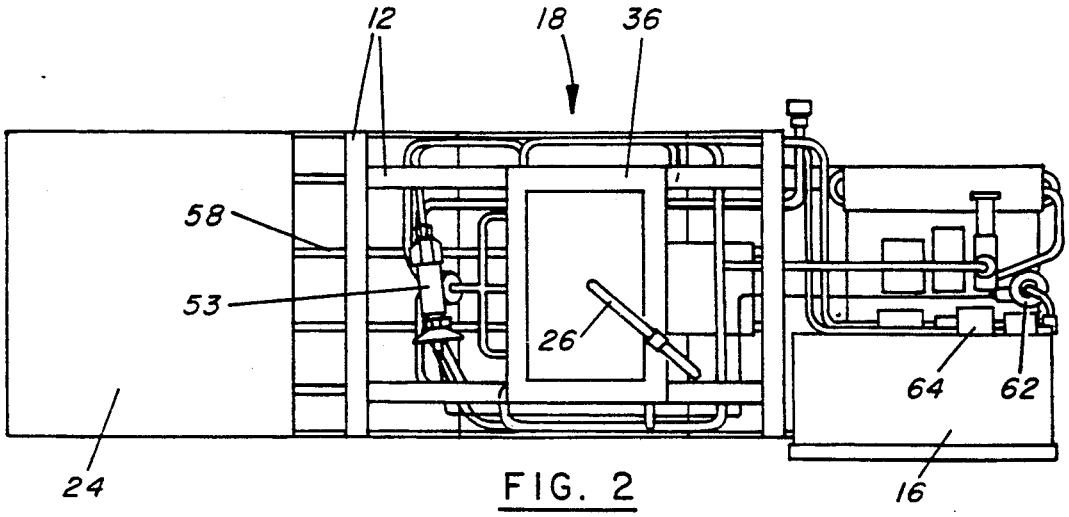
FIG. 2 is a top view of the ice machine of FIG. 1.
Figure 4:
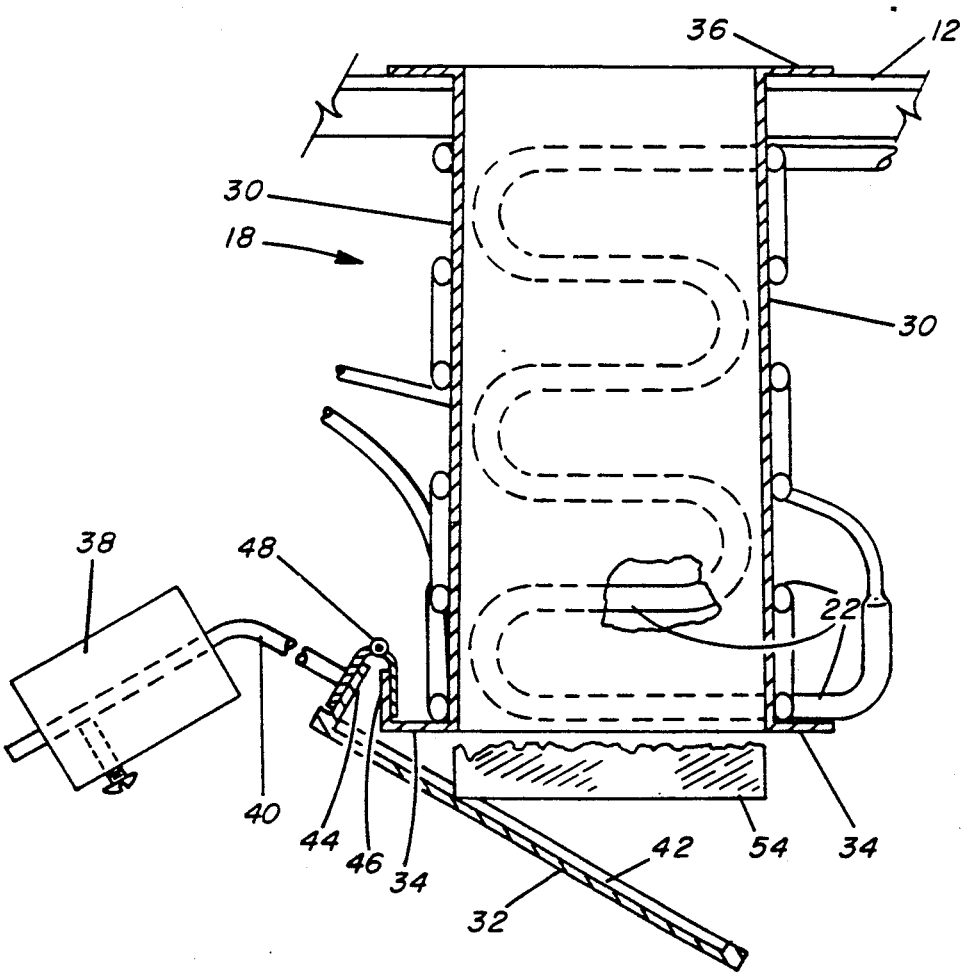
FIG. 4 is an enlarged, front elevational, crosssection of the ice chamber employed in the ice machine of FIG. 1 with the counterbalanced bottom lid partly open.
Figure 3:
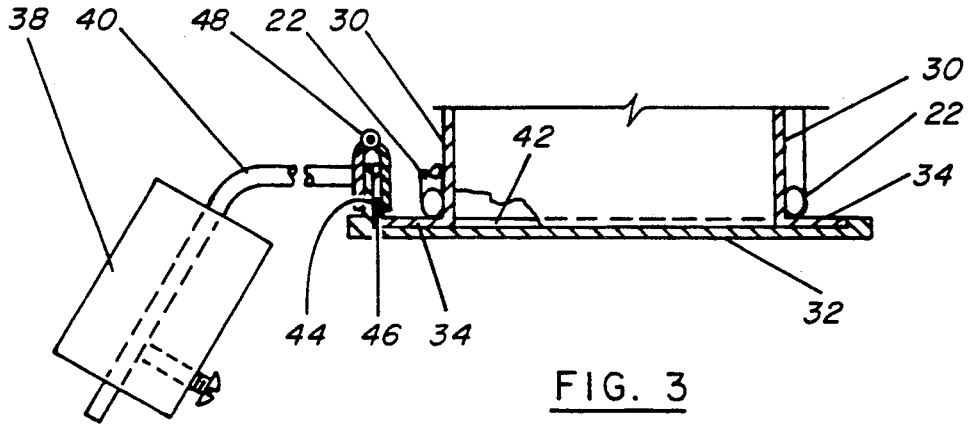
FIG. 3 is an enlarged, cross-section, partial view of the bottom part of the ice chamber of the machine of FIG. 1 with the hinged counterbalanced bottom lid in the closed position.

Referring to FIG. 1 of the drawings, there is shown a perspective view of a machine 10 of the present invention for making and harvesting blocks of ice automatically. Once the machine is started, it is not necessary for an operator to be present during the ice making cycle including harvesting of the ice block. After the block of ice is harvested, the machine automatically restarts to make another block of ice. The machine comprises an angle iron framework 12 which provides support for the operable components which include a compressor 14, control panel 16, ice chamber 18, water pump 20, refrigerant lines 22, an ice block harvest chamber 24, water line 26 and hot gas line 28. In the specific embodiment shown in FIGS. 1–6 and described herein, the machine is designed for the production of ice blocks weighing about nine pounds. As such, the machine has an ice chamber 18, best shown in FIGS. 3 and 4, with tapered side walls 30 and a counter balanced hinged bottom lid 32. The tapered configuration facilitates release of the ice block from the ice chamber. The rectangular chamber has an internal dimension (ID) of 4 by 6 inches at the top edge and ID of 4½ by 6½ inches at the bottom edge. The chamber has a height of 12 inches. At the bottom edge of the side walls, there is a flange 34, the function of which will be explained hereinafter, which extends completely around the perimeter of the four side walls. In the embodiment shown, the flange 34 extends out from the side wall ¾ inch. This dimension can vary from about ½ inch or less to 1 inch with satisfactory results. A flange 36 is provided at the top edge which supports the ice chamber on frame member 12. Other support means for the chamber can be used such as bolting it to the frame. The bottom of the ice chamber is a counter balanced hinged lid 32 which is provided with a weight 38 which is slidably adjustable on rod member 40 and secured thereto using a set screw. The weight is made of mild steel and has a diameter of 2 inches and length of 4 inches. The hinged lid 32 is in the form of a shallow tray which mates with flanges 34 at the bottom of side walls 30. The lid has an ID of about 6½ by 8½ inches with a lip 42 of about 3/16 inch along 3 sides and a lip 44 of about ¾ inch along one side. To the lip member 44 of lid 32 and upright member 46 of flange 34 is attached strap or piano hinge 48 as by recessed bolts or screws (not shown) or the like. In turn, rod member 40 is attached to hinge 48 by welding or other means. The ice chamber side walls (including the bottom flange 34) are suitably made of stainless steel of 12 gauge and the bottom lid of 18 gauge material. Lower and higher gauge material can be used. Material other than stainless steel having good thermal conductivity can be used such as aluminum and aluminum alloys such as aluminum/zinc to form the ice chamber. The cooperative mating relationship of lid 32 and flange 34 of the bottom edge of side walls 30 is important to the practice of the present invention. In the operation of the machine, a small amount of water is introduced into the ice chamber through water line 26 (⅜ inch) in an amount sufficient to fill or substantially fill lid 32. This water is then frozen which results in an ice seal between flange 34 and the lid 32 including turned up lip 42 and 44 thereof. This formation of the ice seal takes about 5 minutes. The seal is continuous around the perimeter of the bottom of the ice chamber and securely holds lid 32 in place and is leak proof. The balance of the water, somewhat more than one gallon, is then metered into the ice chamber and the freezing cycle continued until the ice block 54 (about 9 lbs.) is formed. An overflow outlet 50 is provided in a side wall of the chamber to drain excess water during the filling operation into a reservoir 52.

Refrigerant lines or coils 22 are arranged in serpentine design and bonded, as by soldering or the like, to the sidewalls 30 of the chamber. This refrigeration evaporator circuit is provided with refrigerant by introduction thereof at the position of the bottom edge of wall 30 and flange 34 from a four circuit expansion valve distributor or a four-cap tube system 53 which in turn is connected to compressor 14 (⅓ HP Copelweld). This refrigerant circuit design facilitates formation of the ice seal between flange 34 and bottom lid 32 and also causes freezing of the water from the bottom to the top, thereby not top freezing which would cause the ice chamber to be damaged from center freeze expansion. The lines are suitably ⅜ inch and made of refrigeration soft copper tubing. A refrigerant such as Freon 12 or 502 can be used.

Figure 5:
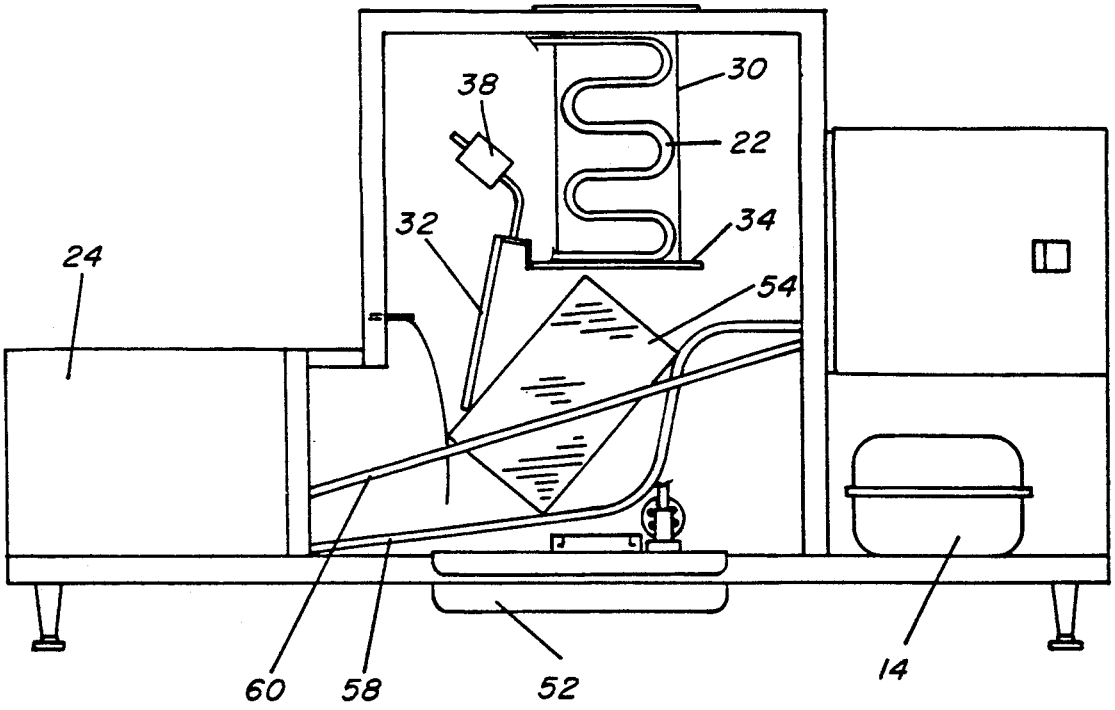
FIG. 5 is a front elevational view of the ice machine of FIG. 1 showing the gravity release of an ice block from the ice chamber.

After the ice block is formed, the refrigeration cycle is reversed to a hot gas defrost, mode. The hot gas enters the expansion valve distributor 53 through hot gas port 56 which has a check valve and defrosts the ice seal at the ice chamber bottom flange 34 and bottom lid 32. The hot gas also defrosts the ice chamber side walls from the ice block to free it to gravity drop, as shown in FIG. 5, onto an inclined ramp or sliding system 58 having guide rails 60. The slide is sufficiently inclined so that the ice block 54 has adequate momentum to move into the ice block harvest chamber 24 and then onto an automatic conveyor (not shown) or the like for transport into an ice room for storage and bagging. The defrost mode takes about 5 minutes. Total time, from start to harvest, to produce the ice block is 3 hours. Once the ice block clears the slide, hinged bottom lid 32 automatically returns to the closed position shown in FIG. 3 and the machine automatically restarts to produce the next block of ice. The hot gas defrost system can be supplemented, for example, by adding a heater element (not shown) such as an electrical heating plate, resistance coils or resistive ink to the outer bottom surface of hinged lid 32. The electrical heater element can be encapsulated or coated with.

As mentioned, the machine is adaptable for use with a bank or series of ice chambers in place of just one ice chamber as shown for illustration herein. As the number of chambers is increased so as to produce a plurality of ice blocks at one time, a correspondingly larger compressor will be required. For example, if the number of ice chambers is increased to 5, a compressor of about 1 HP should be used instead of the ⅓HP compressor described.

A nine pound ice block is a popular size. The machine is adaptable to making smaller or larger blocks of ice by simply changing the size of the ice chamber. If the size of the block is increased, it is advisable to increase the area of flange 34 to form a larger ice seal which will accommodate the added weight of the increased volume of water. Similarly, the ice chamber can take the configuration of a square, if it is desired to have square blocks instead of the rectangular block shown herein.

Figure 6:
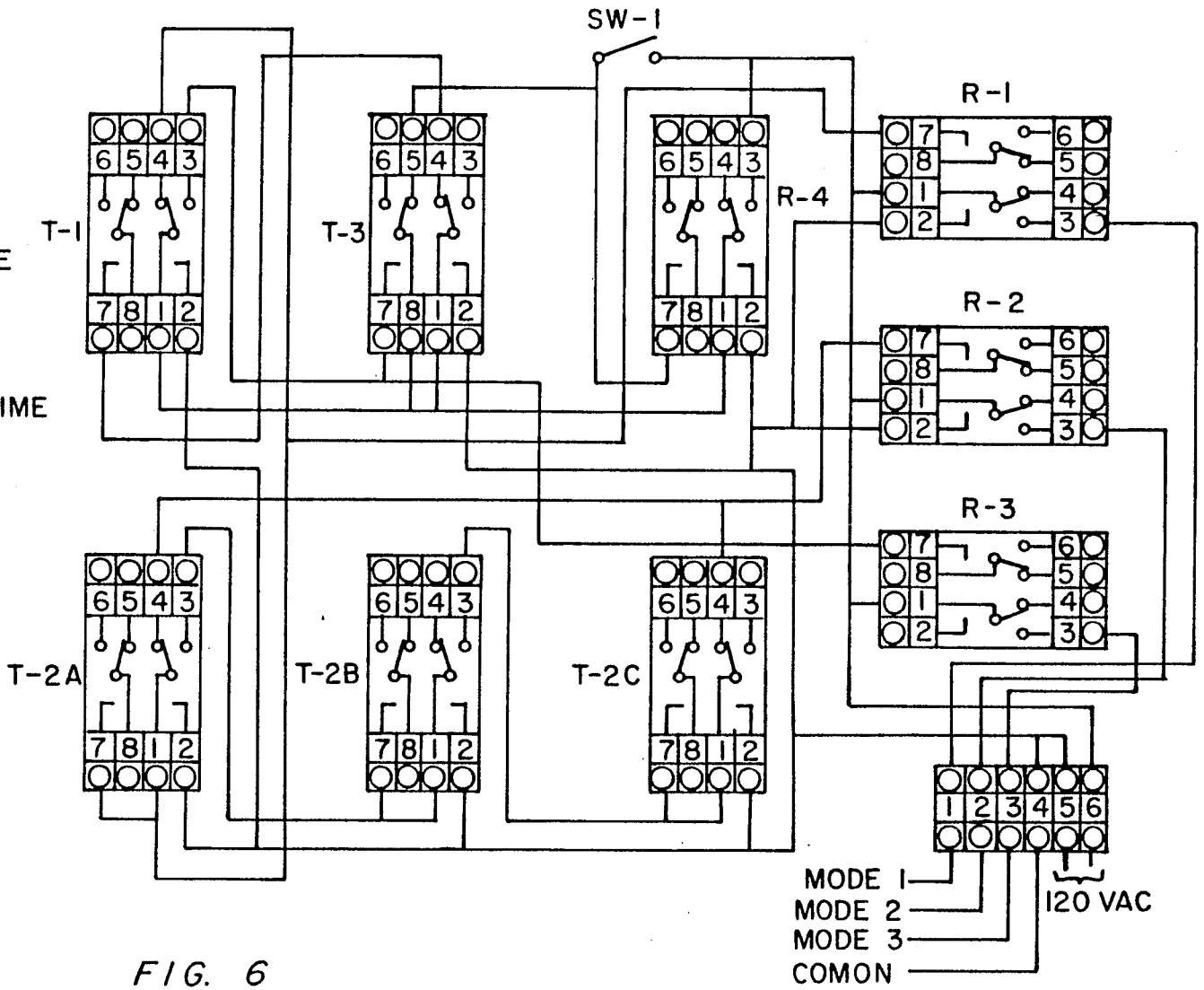
FIG. 6 is a schematic of the electrical control system.

In FIG. 6 is shown a schematic of the control system for the ice machine of the present invention. In operation, timer setting T-1 and relay R-1 activate solenoid valve 62 to start the freezing cycle (Mode 1). Timer setting T-2A and relay R-2 activate pump 20 which supplies a small amount of water to lid 32 (Mode 2 first on time). Timer setting T-2B delays the pump from supplying additional water to the ice chamber until the ice seal is formed (Mode 2 off time). Timer setting T-2C starts the second on time for the pump to now supply water sufficient to fill the ice chamber up to the water overflow outlet (Mode 2 second on time). This allows over fill of water to pass out of the ice chamber outlet and return to the water reservoir 52. Timer setting T-3 and relay R-3 activate solenoid valve 64 to start the hot gas defrost cycle to harvest the block of ice (Mode 3 on time). When Mode 3 comes on, Mode 1 goes off. If SW-1 is opened during cycle, the machine shuts off at end of Mode 3. Timer settings T-1, T-2A,B and C, and T-3 are Omron model no. H3BA-8AC120 and relays R-1 to R-4 are Omron model no. MK2EPNUARC120.

The ice block machine of the present invention makes block ice totally automatic. It requires only occasional maintenance to correct for normal wear of components. In addition, it makes blocks of ice in one-fourth the time and uses one-fourth of the electric power that is required by other ice block making systems.

What is claimed is:

1. A machine for making and harvesting a block of ice automatically which comprises:

a supporting framework;

an ice chamber mounted on said framework for holding water while it is being frozen to form said block of ice, said ice chamber having four sidewalls and a bottom wall, said sidewalls having a flange extending outward from the bottom edge thereof, said bottom wall being in the form of a counter balanced shallow tray which cooperatively mates with said flange and is hingedly connected along one side of said flange;

water supply means of or metering water into said chamber in two steps, the amount of water metered in the first step being only a small amount sufficient to fill or substantially fill said tray and the amount of water metered in the second step being sufficient to form the block of ice;

refrigeration means for providing refrigerant to said sidewalls and flange including refrigerant lines arranged in serpentine design on said sidewalls for providing refrigerant to said sidewalls and said flange, said refrigerant being introduced first into said refrigerant lines at the juncture of the bottom edge of the sidewalls and flange so that the water metered in he first step is frozen to form an ice seal between said tray and flange and the water metered in the second step is frozen from the bottom to the top of the chamber;

defrost means for defrosting the sidewalls and flange of said chamber sufficient to break said ice seal and to release said block of ice from the chamber and permit it to drop by gravity from the chamber; and means for automatically controlling the water supply means, refrigeration means and defrost means.

2. The machine according to claim 1 wherein the sidewalls of said ice chamber are slightly tapered outwardly from the top to the bottom edge to facilitate harvesting of the block of ice.

3. The machine according to claim 2 wherein one sidewall has a water overflow outlet therein.

4. The machine according to claim 1 wherein said machine includes receiving means for receiving said block of ice when it drops from said chamber.

* * * * *